US007997778B2

(12) United States Patent
Okada

(10) Patent No.: US 7,997,778 B2
(45) Date of Patent: Aug. 16, 2011

(54) VEHICLE LIGHT

(75) Inventor: Hidetaka Okada, Kawaguchi (JP)

(73) Assignee: Stanley Electric Co., Ltd., Tokyo (JP)

( * ) Notice: Subject to any disclaimer, the term of this patent is extended or adjusted under 35 U.S.C. 154(b) by 287 days.

(21) Appl. No.: 12/345,402

(22) Filed: Dec. 29, 2008

(65) Prior Publication Data

US 2009/0168446 A1 Jul. 2, 2009

(30) Foreign Application Priority Data

Dec. 26, 2007 (JP) ..... 2007-334804

(51) Int. Cl.
*F21V 7/00* (2006.01)

(52) U.S. Cl. ..... 362/516; 362/545; 362/211

(58) Field of Classification Search ..... 362/516, 362/543, 544, 545, 230, 231, 211–215, 800
See application file for complete search history.

(56) References Cited

U.S. PATENT DOCUMENTS

| | | | | |
|---|---|---|---|---|
| 4,598,342 | A * | 7/1986 | English et al. | 362/213 |
| 5,544,021 | A * | 8/1996 | Lopez et al. | 362/518 |
| 5,578,893 | A * | 11/1996 | Yamamoto | 313/112 |
| 5,857,764 | A * | 1/1999 | Tabata et al. | 362/214 |
| 6,068,391 | A * | 5/2000 | Saladin et al. | 362/516 |
| 6,439,739 | B1 * | 8/2002 | Sischka | 362/211 |
| 6,474,852 | B1 | 11/2002 | Ohkohdo et al. | |
| 2004/0196663 | A1 * | 10/2004 | Ishida et al. | 362/539 |

FOREIGN PATENT DOCUMENTS

JP 2001-118408 A 4/2001

* cited by examiner

*Primary Examiner* — Bao Q Truong
(74) *Attorney, Agent, or Firm* — Holtz, Holtz, Goodman & Chick PC

(57) ABSTRACT

A vehicle light can include a reflector and a light source. The reflector has a reflection surface formed by at least part of a parabolic cylindrical surface obtained by moving a parabola by parallel displacement, where the parabola has a coefficient of 0.5, a focal length, and a focal point. The light source includes at least one set of at least two light emitting devices that have respective light emission surfaces facing toward the reflection surface. The at least two light emitting devices include a front light emitting device and a rear light emitting device spaced apart by a predetermined distance along an illumination direction of the vehicle light, with the focal point interposed between the front and rear light emitting devices.

20 Claims, 5 Drawing Sheets

VEHICLE LIGHT

This application claims the priority benefit under 35 U.S.C. §119 of Japanese Patent Application No. 2007-334804 filed on Dec. 26, 2007, which is hereby incorporated in its entirety by reference.

BACKGROUND

1. Technical Field

The present invention relates to a vehicle light, and in particular to a vehicle light using a small-sized LED lamp as a light source. The vehicle light can provide a wider illumination area with less illumination unevenness and without using complex lens cuts.

2. Description of the Related Art

FIG. 1 is a front view of a conventional lighting unit 90 employing an LED lamp 91 as a light source. In FIG. 1, the lighting unit 90 is composed of the LED lamp 91 and a reflector 92. The LED lamp 91 is installed with its optical axis inclined toward the reflector. Accordingly, the reflector 92 is present in the illumination direction of the LED lamp 91. The reflector 92 is shaped substantially like a sector of a circle (has a substantially "sector shape"). Furthermore, the reflector 92 has a reflection pattern 92*a* that reflects parallel light beams to form an illumination pattern in front of the reflector 92. (See, for example, Japanese Patent Application Laid-Open No. 2001-118408, the entire contents of which are incorporated herein by reference.)

Since the outer shape of the reflector 92 is the sector shape, when a plurality of the lighting units 90 are combined with the LED lamps 91 disposed around the center of the combined unit, the combined unit 80 can form the circular shape shown in FIG. 2. A plurality of the lighting units 90 can alternatively be combined with the positions of the LED lamps 91 alternating from side to side, to form the combined unit 81 having an elongated shape (such as a rectangular shape), as shown in FIG. 3.

In the configuration of the conventional lighting unit 90 as shown in FIG. 1, the spread end portion of the sector shape of the reflector 92 is located farthest from the LED lamp 91. In general, light amount may be reduced in inverse proportion to the square of the distance. Accordingly, the farthest portion of the sector-shaped reflector may project less light than the portion near to the center (the portion adjacent to the LED lamp). This trend may be enhanced because an LED lamp can generally emit light with the highest luminous intensity in the optical axis direction thereof and the luminous intensity may decrease as the emission direction deviates from the optical axis. As a result, even when a plurality of lamps 91 are combined, the lighting unit 90 itself may provide uneven light distribution.

SUMMARY

According to an aspect of the present invention, a vehicle light includes a reflector having a reflection surface, and a light source including at least one set of at least two light emitting devices which have respective light emission surfaces facing toward the reflection surface. The reflection surface is formed of a lower half (or upper half) of a parabolic cylindrical surface. With reference to FIG. 5, the parabolic cylindrical surface is obtained by setting an imaginary horizontal line H and an imaginary vertical line Q, which are perpendicular to each other, to provide a crossing point P. Two vertically spaced points on the vertical line Q are set at a distance of 2f from the crossing point P. A parabola is set to have a focal point F at the crossing point P, a coefficient of 0.5 and a focal distance f, so that the parabola passes through the two vertically spaced points on the vertical line Q and one point on the horizontal line H that is at the focal distance f from the crossing point P. The parabola can be expressed by the following formula:

$$x = \frac{(ay)^2}{f} - f$$

wherein a is the coefficient and is preferably 0.5.

The parabolic cylindrical surface is formed by moving the parabola in a direction perpendicular to both the horizontal line H and the vertical line Q. In this vehicle light, the set of at least two light emitting devices includes a front light emitting device and a rear light emitting device spaced apart by a distance that is substantially the same as the focal distance f along an illumination direction of the vehicle light with the focal point F disposed at a center between the front and rear light emitting devices.

In the vehicle light configured as above, the light source may include a plurality of the sets of light emitting devices, and the sets are disposed along a direction perpendicular to both the horizontal line H and the vertical line Q at equal intervals.

In the vehicle light configured as above, the set can include at least three light emitting devices, including a center light emitting device disposed at the focal point F at the center between the front and rear light emitting devices.

According to another aspect of the present invention, a vehicle light can include: a reflector having a reflection surface formed by at least part of a parabolic cylindrical surface obtained by moving a parabola by parallel displacement, the parabola having a coefficient of 0.5, a certain focal length, and a certain focal point; and a light source including at least one set of at least two light emitting devices that have respective light emission surfaces facing toward the reflecting surface, the at least two light emitting devices including a front light emitting device and a rear light emitting device spaced apart by a predetermined distance along an illumination direction of the vehicle light, with the focal point interposed between the front and rear light emitting devices. The parabola can be expressed by the following formula:

$$x = \frac{(ay)^2}{f} - f$$

wherein a is the coefficient and is 0.5.

In the vehicle light configured as above, the light source can include a plurality of the sets of at least two light emitting devices, and the sets are provided along the focal point of the parabolic cylindrical surface of the reflection surface.

In the vehicle light configured as above, the parabolic cylindrical surface can be formed by half of the parabola with respect to an optical axis of the vehicle light passing through the focal point.

In the vehicle light configured as above, each set of the light emitting devices can include a third light emitting device provided at the focal point between the front and rear light emitting devices.

In the vehicle light configured as above, a light amount of at least one of upward and downward light beams of the vehicle light changes if the predetermined distance between the front and rear light emitting devices is changed.

Accordingly, the vehicle light of the present invention can provide a uniform light distribution property suitable for a stop lamp or rear lamp, for example, without providing lens cuts for imparting a desired light distribution property and with a simplified configuration.

BRIEF DESCRIPTION OF THE DRAWINGS

These and other characteristics, features, and advantages of the present invention will become clear from the following description with reference to the accompanying drawings, wherein.

DETAILED DESCRIPTION

Figure 1:
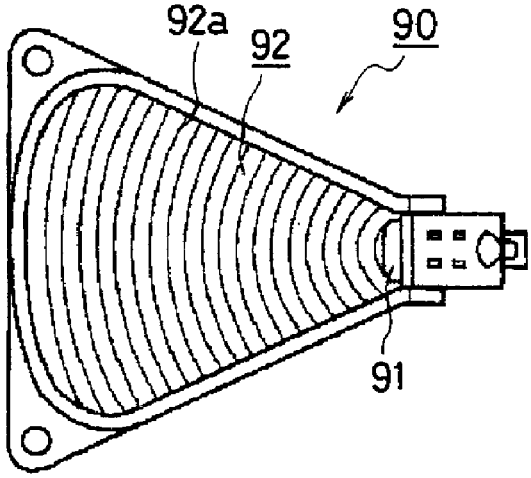
Fig. 1 Conventional Art
FIG. 1 is a front view showing an example of a conventional lighting unit.
Figure 2:
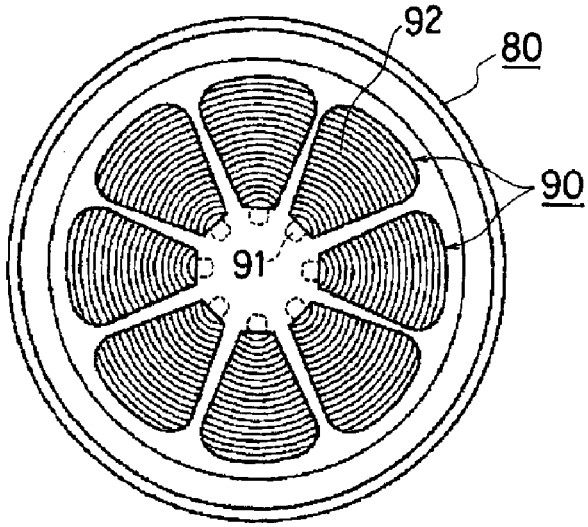
Fig. 2 Conventional Art
FIG. 2 is a diagram illustrating an example of combining conventional lighting units.
Figure 3:
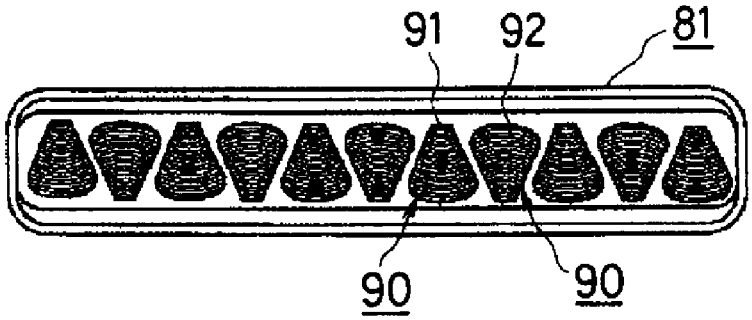
Fig. 3 Conventional Art
FIG. 3 is a diagram illustrating another example of combining conventional lighting units.
Figure 4:
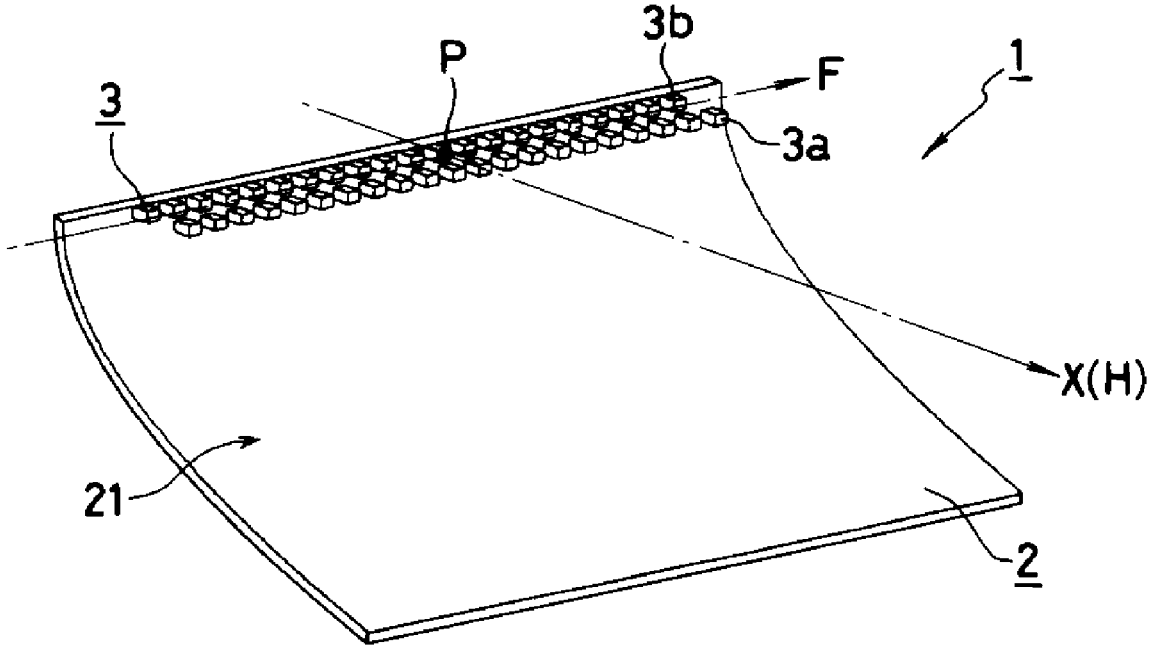
FIG. 4 is a perspective view illustrating a first exemplary embodiment of a vehicle light according to the present invention.
Figure 5:
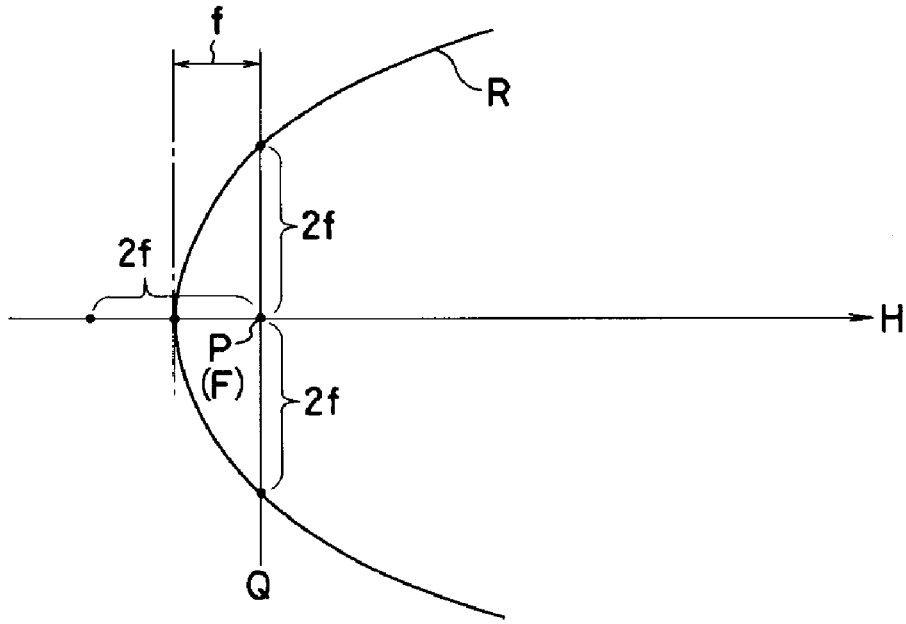
FIG. 5 is a diagram illustrating the direction of the reflection surface of the vehicle light according to the present invention.

FIG. 4 shows a vehicle light 1 according to the present invention. The vehicle light 1 can include a reflector having a reflection surface 2 and LED lamps 3 (including lamps 3*a* and 3*b*) serving as a light source. The reflection surface 2 can be formed of at least part of, or for example, a lower half, of a parabolic cylindrical surface 21 based on a parabola R as shown in FIG. 5. The center axis X of the parabolic cylindrical surface 21 is aligned in the horizontal direction (in the illumination direction of the vehicle light) in the present invention.

As shown in FIG. 5, to form the parabolic cylindrical surface 21, first an imaginary horizontal line H and an imaginary vertical line Q, which are perpendicular to each other, are set to provide a crossing point P. In this system, two vertically spaced points on the vertical line Q are set at a distance of 2f from the crossing point P. The parabola R is set to have its focal point F at the crossing point P, a coefficient of 0.5 and a focal distance f, for example, meaning that the parabola R passes through the two vertical points on the vertical line Q at the distance 2f from the crossing point P and passes through and one point on the horizontal line H at a distance f from the crossing point P. The parabola can be expressed by the following formula:

$$x = \frac{(ay)^2}{f} - f$$

wherein a is the coefficient and is preferably 0.5.

The parabolic cylindrical surface 21 can be obtained by moving the parabola R in a direction perpendicular to both the horizontal line H and the vertical line Q (parallel displacement). Moving the parabola R also obtains a line corresponding to the focal point F.

In the present invention, the reflection surface 2 can be obtained as a lower half (below the horizontal line H) of the parabolic cylindrical surface 21 obtained in this manner. As shown in FIG. 4, the focal point F of the reflection surface 2 can be located near the upper edge of the reflection surface 2 as a line.

In the present exemplary embodiment, as described above, the reflection surface 2 is formed of the lower half of the parabolic cylindrical surface 21 with respect to the horizontal line H. The present invention is not limited to this structure. The reflection surface 2 may be the upper half of the parabolic cylindrical surface 21, as described later, or may be another part of the parabolic cylindrical surface (for example, less than half of the parabolic cylindrical surface) in accordance with the intended purpose.

Figure 6:
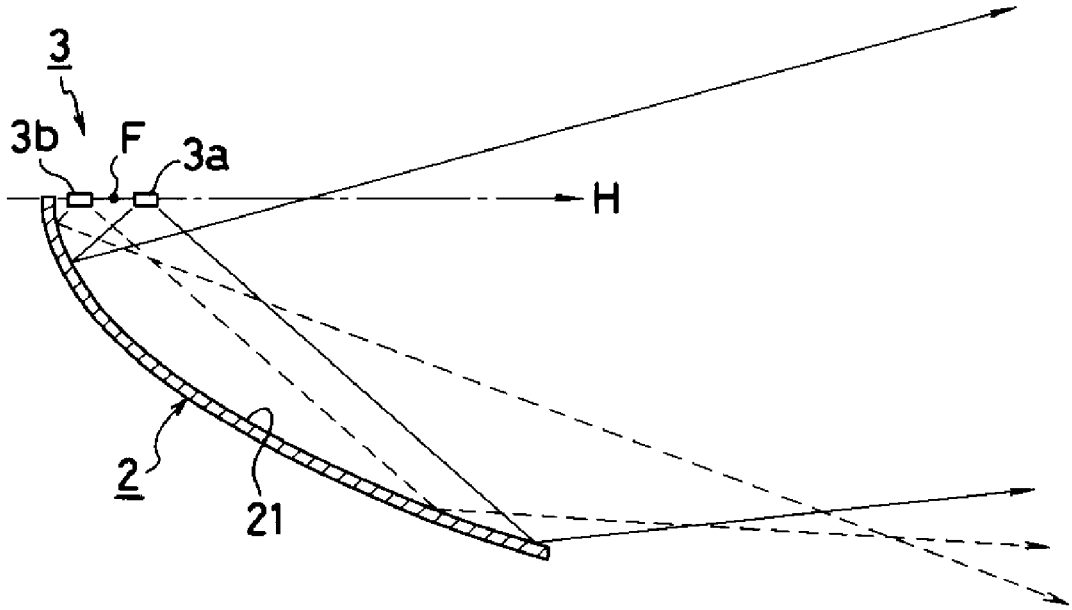
FIG. 6 is a vertical cross-sectional view of the reflection surface of the vehicle light taken along the X-axis in FIG. 4.

As shown in FIGS. 4 and 6, the vehicle light 1 can employ the LED lamps 3 (provided in sets of two LED lamps 3*a* and 3*b*). The illumination direction, or the light emission direction, of the LED lamps 3 is directed to the reflection surface 2. In the illustrated exemplary embodiment, the LED lamps 3 are installed to the vehicle light 1 while the light emission surfaces thereof face downward to the reflection surface 2 to emit light downwardly.

In the present invention, each set of the LED lamps 3 can be composed of an LED lamp 3*a* and an LED lamp 3*b*, which are spaced apart by a distance that is substantially the same as the focal distance f. The set of the LED lamps 3 can be disposed along the illumination direction of the vehicle light so that the focal point F of the reflection surface 2 is disposed at the center between the LED lamps 3*a* and 3*b*, as shown in FIG. 6. The vehicle light 1 can include a plurality of the sets of LED lamps 3 at substantially equal intervals as illustrated in FIG. 4, for example. Hereinafter, the LED lamps 3 may be referred to as a front LED lamp 3*a* and a rear LED lamp 3*b* along the illumination direction of the vehicle light.

The front LED lamp 3*a* can emit light beams from a position in front of the focal point F in the illumination direction (of the vehicle light 1). In this instance, the emission surface of the front LED lamp 3*a* is directed downward, to the reflection surface 2. Therefore, the front LED lamp 3*a* can emit light beams that are incident on the reflection surface 2 to be reflected by the reflection surface 2 and basically projected as upward light beams. The closer the emitted light beams travel to the edge of the reflection surface 2 in the illumination direction, the smaller the angles at which the light beams are reflected by the reflection surface 2. Accordingly, the luminous intensity of the upward light beams decreases as the emitted light beams travel closer to the edge of the reflection surface 2 in the illumination direction. On the other hand, the light beams emitted from the front LED lamp 3*a* directed horizontally rearward, or substantially to the focal point F, can be reflected in a reverse direction, meaning the reflected light beams travel in the horizontal forward direction.

The rear LED lamp 3*b* can emit light beams from a position behind the focal point F in the illumination direction (of the vehicle light 1). In this case, the light beams emitted from the rear LED lamp 3*b* are incident on the reflection surface 2 to be reflected by the reflection surface 2 and basically projected as downward light beams. The closer the emitted light beams travel to the edge of the reflection surface 2 in the illumination direction, the smaller the angles at which the light beams are reflected by the reflection surface 2. Accordingly, the luminous intensity of the downward light beams decreases as the emitted light beams travel closer to the edge of the reflection surface 2 in the illumination direction. In the present invention, adjustment of the distance between an LED lamp 3 and the focal point F can control the upward angle (or the downward angle) of the reflected light beam, thereby imparting the light beams with a desired light distribution property.

Figure 7:
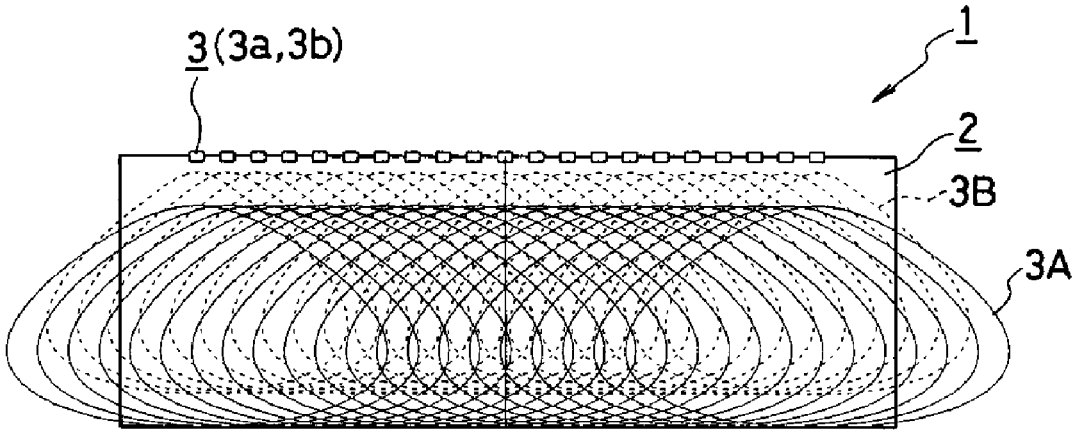
FIG. 7 is a front view illustrating a state in which the light beams emitted from the LED lamps travel toward the reflection surface of the vehicle light according to the present invention.

FIG. 7 is a front view of the vehicle light 1 according to the present invention. As shown (viewed from the front), twenty-one pairs of LED lamps 3 (3*a* and 3*b*) are installed along the upper edge of the reflection surface 2. In FIG. 7, each shell shaped frame line 3A illustrated by the solid line represents the area where the light beams from a front LED lamp 3*a* reach. The light beams reaching this area can be reflected and emitted with a certain directionality, meaning that the light distribution pattern can be imparted with uniform luminous intensity as a whole.

Each frame line 3B illustrated by the dotted line in FIG. 7 represents the area where the light beams from a rear LED lamp 3*b* reach. The areas 3B can overlap the areas 3A so that the light beams from the lamps 3*a* and 3*b* compensate for each other, thereby forming a light distribution property with a more uniform luminous intensity.

As shown in FIG. 7, when viewed from the front, the areas 3A and 3B where the direct light beams from the LED lamps 3*a* and 3*b* reach may have narrow upper portions. This would appear to provide insufficient luminous intensity at the upper area of the reflection surface 2. However, the upper areas of the areas 3A and 3B are near the LED lamps 3, and accordingly, light beams with high luminous flux density can reach there. In addition, the light beams can spread in the lateral direction with the LED lamp as a center. As a result, vertical unevenness of brightness may be prevented.

In the present invention, part of the parabolic cylindrical surface 21 can be adopted as the reflection surface 2. With this structure, the reflection surface can mainly control the vertical direction in which the light beams travel. Accordingly, the light distribution pattern can easily be formed such that the vertical illumination angle may be relatively narrow and the horizontal illumination angle may be relatively wide. The vehicle lamp with the configuration described above can provide a light distribution property suitable for rear lamps, stop lamps, fog lamps, and other vehicle lamps. In other words, the light distribution pattern can be designed in a simple manner.

In the configuration of the vehicle light 1 of the present invention, the LED lamps 3 (3*a*, 3*b*) can be disposed at a position where they do not interfere with the light path of the reflected light from the reflection surface 2. In this instance, the LED lamps 3 (3*a*, 3*b*) can be a surface mount type so that all of the LED lamps 3 (3*a*, 3*b*) can be assembled integrally on a single printed circuit board. This can simplify the configuration and the assembly process.

Figure 8:
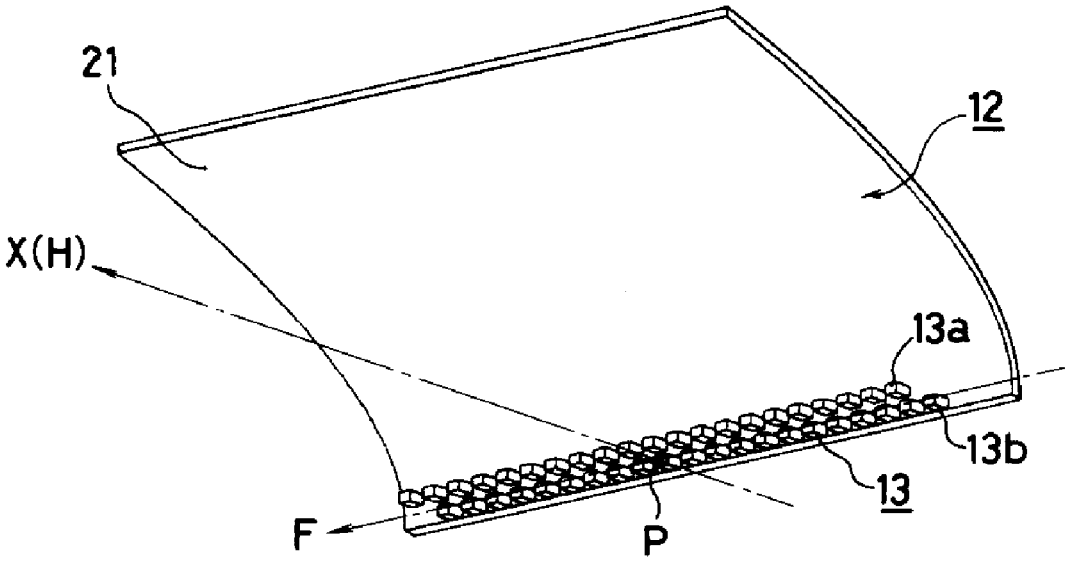
FIG. 8 is a perspective view showing a second exemplary embodiment of the vehicle light according to the present invention.

FIG. 8 is a diagram illustrating a second exemplary embodiment of the vehicle light according to the present invention. In this exemplary embodiment, the reflection surface 12 can be composed of an upper half of the parabolic cylindrical surface 21 above the horizontal line H. Accordingly, the same or similar action and effects can be obtained with the structure of the second exemplary embodiment as with the first exemplary embodiment (see FIG. 4). In addition, in the first exemplary embodiment, the adjustment of the distance between the focal point F and the position where the front LED lamp 3*a* is disposed can control the upward angle of the reflected light beams from the reflection surface 2 while the adjustment of the distance between the focal point F and the position where the rear LED lamp 3*b* is disposed can control the downward angle of the reflected light beams from the reflection surface 2. In the second exemplary embodiment, the position of the front LED lamp 13*a* can control the degree of the downward angle of the reflected light beams while the position of the rear LED lamp 13*b* can control the degree of the upward angle of the reflected light beams.

In the present invention, the first and second exemplary embodiments adopt the LED lamps 3 and 13 which cannot be directly seen from the front. That is, emission surfaces of the LED lamps 3 and 13 are not directed forward. Accordingly, the light emission surface of the vehicle light can be made even easily with a simple configuration. By subjecting the reflection surface 2 or 12 to a satin finish process, a more uniform light distribution can be obtained extremely simply, without any additional member or structural change.

Figure 9:
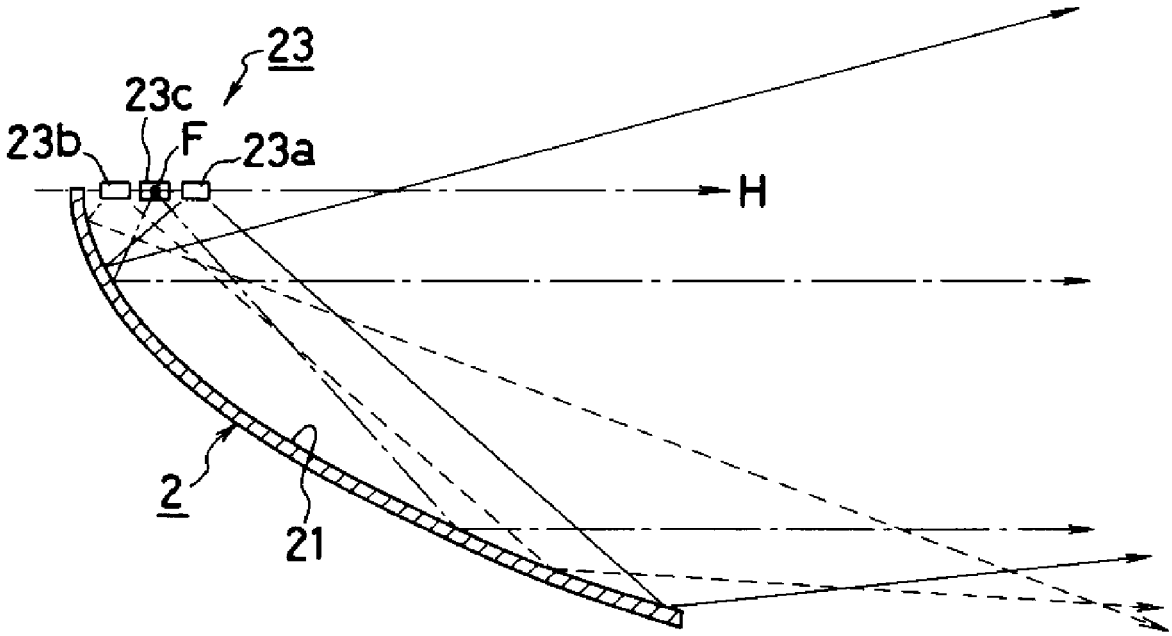
FIG. 9 is a diagram illustrating a third exemplary embodiment of the vehicle light according to the present invention.

FIG. 9 is a diagram illustrating a third exemplary embodiment of the vehicle light according to the present invention. In the first and second exemplary embodiments, the distance between the front LED lamp 3*a* (13*a*) and the focal point F and the distance between the rear LED lamp 3*b* (13*b*) and the focal point F can be controlled to adjust the vertical angle of the reflected light beams (upward or downward), thereby providing a desired light distribution property.

It may be necessary to provide a vehicle light that has a certain light intensity toward the front of the vehicle body. In the third exemplary embodiment, three LED lamps 23 are used as one set. Namely, in addition to the front LED lamp 23*a* and the rear LED lamp 23*b* which are disposed with the focal point F interposed therebetween, a center LED lamp 23*c* is additionally provided substantially at the focal point F.

In accordance with this configuration, the light beams emitted from the center LED lamp 23*c* disposed at the focal point F can be incident on the reflection surface 2 (12) to be projected forward as parallel light beams. The vehicle light configured in this manner can illuminate the front of the vehicle body with a higher luminous intensity, which in turn can improve the road surface visibility to the driver as well as the long-distance visibility to the driver of other vehicles or pedestrians.

The vehicle lights in accordance with the present invention can be applied to a stop lamp, tail lamp, signal lamp or other vehicle lamp that requires a uniform light distribution property, and can be applied to an auxiliary vehicle headlamp when the vehicle lamp can provide a higher front luminous intensity (as in the third embodiment, for example).

It will be apparent to those skilled in the art that various modifications and variations can be made in the present invention without departing from the spirit or scope of the present invention. Thus, it is intended that the present invention cover the modifications and variations of the present invention provided they come within the scope of the appended claims and their equivalents. All related art references described above are hereby incorporated in their entirety by reference.

What is claimed is:

1. A vehicle light comprising:

a reflector having a reflection surface; and a light source including at least one set of at least two light emitting devices which have respective light emission surfaces facing toward the reflection surface, wherein the reflection surface is formed of a lower half of a parabolic cylindrical surface obtained by moving a parabola having a focal distance f, and wherein the set of at least two light emitting devices comprises a front light emitting device and a rear light emitting device spaced apart by a distance that is substantially the same as the focal distance f along an illumination direction of the vehicle light with a focal point F disposed at a center between the front and rear light emitting devices.

2. The vehicle light according to claim 1, wherein the parabolic cylindrical surface is obtained in such a manner that an imaginary horizontal line H and an imaginary vertical line Q, which are perpendicular to each other, are set to provide a crossing point P, two vertically spaced points on the vertical line Q are set at a distance of 2f from the crossing point P, the parabola is set to have a focal point F at the crossing point P, a coefficient of 0.5 and a focal distance f, so that the parabola passes through the two vertically spaced points on the vertical line Q and one point on the horizontal line H that is at the focal distance f from the crossing point P, the parabola is expressed by the following formula:

$$x = \frac{(ay)^2}{f} - f$$

wherein a is the coefficient of 0.5, and the parabolic cylindrical surface is formed by moving the parabola in a direction perpendicular to both the horizontal line H and the vertical line Q.

3. The vehicle light according to claim 1, wherein the light source includes a plurality of the sets of light emitting devices, and the sets are disposed along a direction parallel with a moving direction of the parabola at equal intervals.

4. The vehicle light according to claim 2, wherein the light source includes a plurality of the sets of light emitting devices, and the sets are disposed along a direction perpendicular to both the horizontal line H and the vertical line Q.

5. The vehicle light according to claim 1, wherein the set includes at least three light emitting devices, including a center light emitting device disposed at the focal point F at the center between the front and rear light emitting devices.

6. The vehicle light according to claim 2, wherein the set includes at least three light emitting devices, including a center light emitting device disposed at the focal point F at the center between the front and rear light emitting devices.

7. The vehicle light according to claim 3, wherein the set includes at least three light emitting devices, including a center light emitting device disposed at the focal point F at the center between the front and rear light emitting devices.

8. The vehicle light according to claim 4, wherein the set includes at least three light emitting devices, including a center light emitting device disposed at the focal point F at the center between the front and rear light emitting devices.

9. A vehicle light comprising:

a reflector having a reflection surface formed by at least part of a parabolic cylindrical surface that is obtained by moving a parabola by parallel displacement, the parabola having a focal length, and a focal point; and a light source including at least one set of at least two light emitting devices that have respective light emission surfaces facing toward the reflection surface, the at least two light emitting devices comprising a front light emitting device and a rear light emitting device spaced apart by a predetermined distance along an illumination direction of the vehicle light, with the focal point interposed between the front and rear light emitting devices, wherein the light source includes a plurality of the sets of at least two light emitting devices, and the sets are provided along the focal point of the parabolic cylindrical surface of the reflection surface.

10. The vehicle light according to claim 9, wherein the parabola is expressed by the following formula:

$$x = \frac{(ay)^2}{f} - f$$

wherein a is 0.5, and f is the focal length of the parabola.

11. The vehicle light according to claim 10, wherein the parabolic cylindrical surface is formed by half of the parabola with respect to an optical axis of the vehicle light passing through the focal point.

12. The vehicle light according to claim 9, wherein the parabolic cylindrical surface is formed by half of the parabola with respect to an optical axis of the vehicle light passing through the focal point.

13. The vehicle light according to claim 10, wherein each set of the light emitting devices includes a third light emitting device provided at the focal point between the front and rear light emitting devices.

14. The vehicle light according to claim 9, wherein each set of the light emitting devices includes a third light emitting device provided at the focal point between the front and rear light emitting devices.

15. The vehicle light according to claim 11, wherein each set of the light emitting devices includes a third light emitting device provided at the focal point between the front and rear light emitting devices.

16. The vehicle light according to claim 12, wherein each set of the light emitting devices includes a third light emitting device provided at the focal point between the front and rear light emitting devices.

17. The vehicle light according to claim 10, wherein a light amount of at least one of upward and downward light beams of the vehicle light changes if the predetermined distance between the front and rear light emitting devices is changed.

18. The vehicle light according to claim 9, wherein a light amount of at least one of upward and downward light beams of the vehicle light changes if the predetermined distance between the front and rear light emitting devices is changed.

19. A vehicle light comprising:

a reflector having a reflection surface formed by at least part of a parabolic cylindrical surface that is obtained by moving a parabola by parallel displacement, the parabola having a focal length, and a focal point; and a light source including at least one set of at least two light emitting devices that have respective light emission surfaces facing toward the reflection surface, the at least two light emitting devices comprising a front light emitting device and a rear light emitting device spaced apart by a predetermined distance along an illumination direction of the vehicle light, with the focal point interposed between the front and rear light emitting devices, wherein each set of the light emitting devices includes a third light emitting device provided at the focal point between the front and rear light emitting devices.

20. The vehicle light according to claim 19, wherein the parabolic cylindrical surface is formed by half of the parabola with respect to an optical axis of the vehicle light passing through the focal point.

* * * * *